US007448769B1

(12) United States Patent
Coushaine et al.

(10) Patent No.: US 7,448,769 B1
(45) Date of Patent: Nov. 11, 2008

(54) EXTREMELY PORTABLE LED LIGHT

(75) Inventors: Charles M. Coushaine, Rindge, NH (US); Laura Peach, New Boston, NH (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 11/899,060

(22) Filed: Sep. 4, 2007

(51) Int. Cl.
*F21S 9/02* (2006.01)

(52) U.S. Cl. ..... 362/201; 362/200

(58) Field of Classification Search ..... 362/200, 362/201, 652, 196
See application file for complete search history.

(56) References Cited

U.S. PATENT DOCUMENTS 5,158,356 A * 10/1992 Guthrie ..... 362/188
6,070,990 A * 6/2000 Dalton et al. ..... 362/201
6,761,468 B1 * 7/2004 Bogal ..... 362/208
2002/0097575 A1 * 7/2002 Altman ..... 362/189
2003/0137833 A1 * 7/2003 Hsu ..... 362/196

* cited by examiner

*Primary Examiner*—Laura Tso
(74) *Attorney, Agent, or Firm*—William H. McNeill

(57) ABSTRACT

A portable light (10) has a rigid base (12), a power supply (14) having first and second poles (16, 18) within the base and a light source (20) positioned in the base (12). The light source (20) has first and second lead-ins (22, 24). The first lead-in (22) is in contact with the first pole (16) of the power supply (14). Electrical isolation means (26) isolates the second lead-in (24) from the second pole (18) of the power supply (14); and a flexible cover (28) is fitted to the base (12). The cover (28) includes at least one portion (30) that is contactable with the second lead-in (24) whereby pressure on the at least one portion (30) defeats the electrical isolation means (26) and causes a connection between the second lead-in (24) and the second pole (18) of the power supply (14) to actuate the light source (20) while the pressure is being applied.

11 Claims, 6 Drawing Sheets

EXTREMELY PORTABLE LED LIGHT

TECHNICAL FIELD

This invention relates to lighting and more particularly to portable lights. Still more particularly, it relates to portable lights employing light emitting diodes as the light source.

BACKGROUND ART

Many consumers use the illuminated face of a cell phone, or PDA as a dim flashlight to accomplish simple tasks, such as finding a keyhole or reading a map. The light emitted is generally very poor and marginal to say the least. Carrying a small, conventional flashlight that employs incandescent bulbs or "key chain" lights that use LEDs requires the storing and carrying of additional equipment.

It would be an advance in the art to provide a small, portable light that is convenient, waterproof, has an easily replaceable power supply and is readily attachable to device that is already being carried by a consumer.

DISCLOSURE OF INVENTION

It is an object of the invention to obviate the disadvantages of the prior art.

It is another object of the invention to enhance portable lighting devices.

These objects are accomplished, in one aspect of the invention, by a portable light comprising a rigid base; a power supply having first and second poles within said base; a light source positioned in said base, said light source having first and second lead-ins, said first lead-in in contact with said first pole of said power supply; electrical isolation means for isolating said second lead-in from said second pole of said power supply; and a flexible cover fitted to said base, said cover including at least one portion contactable with said second lead-in whereby pressure on said at least one portion defeats said electrical isolation means and causes a connection between said second lead-in and said second pole of said power supply to actuate said light source.

In a preferred embodiment of the invention the light source is a light emitting diode (LED) and the base is provided with an adhesive attachment, whereby the light can be attached to an already carried object.

This portable light eliminates the need of straining ones eyes by the light of a device not meant for primary illumination and does not require carrying a separate lighting source such as a conventional flashlight or a separate light that can, for example, comprise a part of a key chain.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 5:
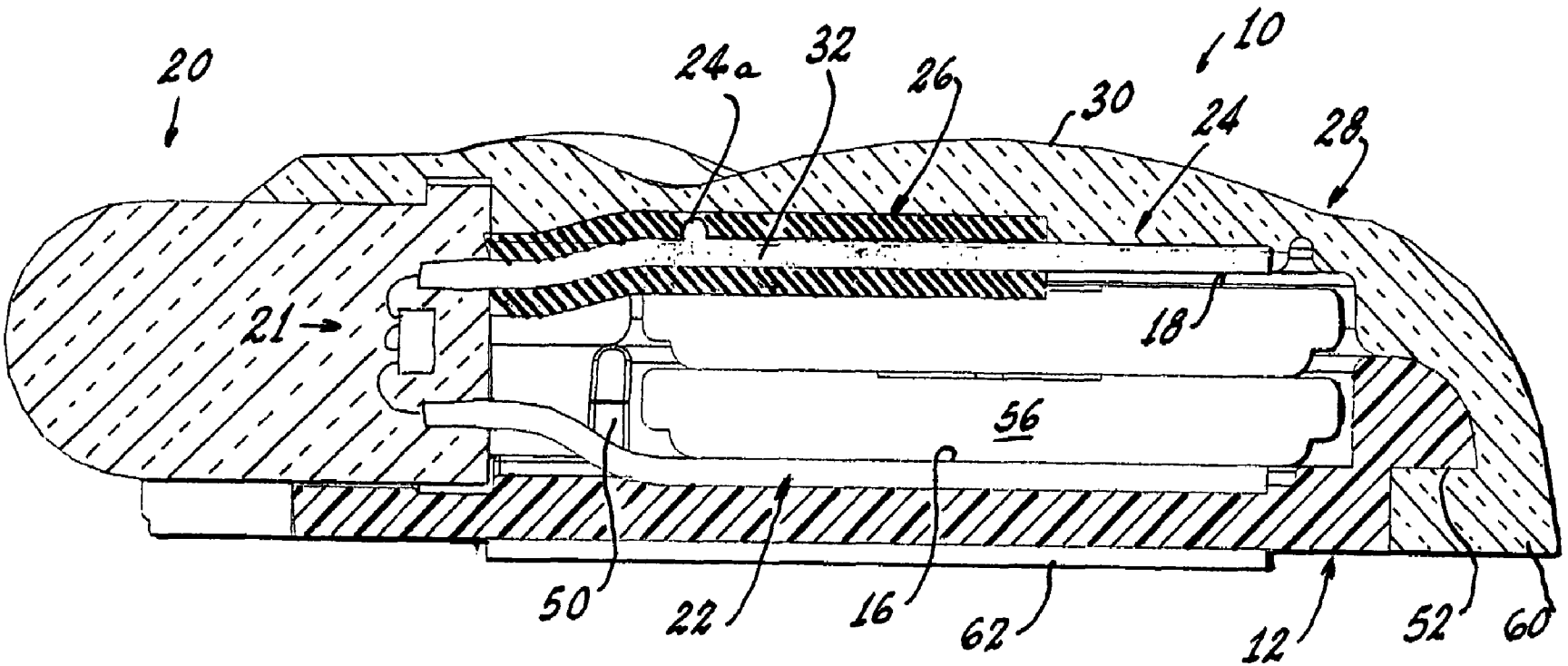
FIG. 5 is an elevational, sectional view of an embodiment of the invention.

Referring now to the drawings with greater particularity, there is shown in FIG. 5 a portable light 10 having a rigid base 12 with a power supply 14 contained therein. The power supply 14 comprises at least on battery 56 having first and second poles 16, 18. As illustrated, two button cell lithium batteries are provided.

A light source 20, preferably in the form of a light emitting diode 21, is positioned in the base 12, the light source 20 having first and second lead-ins 22, 24, the first lead-in 22 being in contact with the first pole 16 of the power supply 14. Electrical isolation means 26 isolates the second lead-in 24 from the second pole 18 of the power supply 14. A flexible cover 28, of a suitable material, such as silicone, is fitted to the base 12. The cover 28 includes at least one portion 30 that is contactable with the second lead-in 24 when pressure is applied to the portion 30, the pressure on the at least one portion 30 defeating the electrical isolation means 26 and causing a connection between the second lead-in 24 and the second pole 18 of the power supply 14 to actuate the light source 20.

Figure 6:
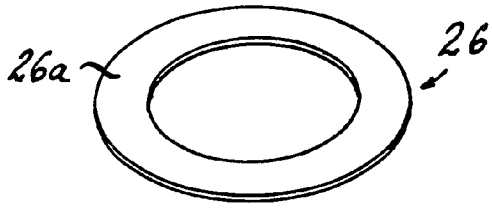
FIG. 6 is a perspective of an alternate insulator.

The electrical isolation 26 means can comprise an electrically insulating washer 26*a* of the type shown in FIG. 6; however, in a preferred embodiment of the invention the electrical isolation means 26 comprises an electrically insulating sleeve 26*b* surrounding a portion 32 of the second lead-in 24 that is adjacent to the light source 20. A protrusion 24*a* is provided on the second lead-in 24 to maintain the sleeve 26*b* in position.

Figure 1:
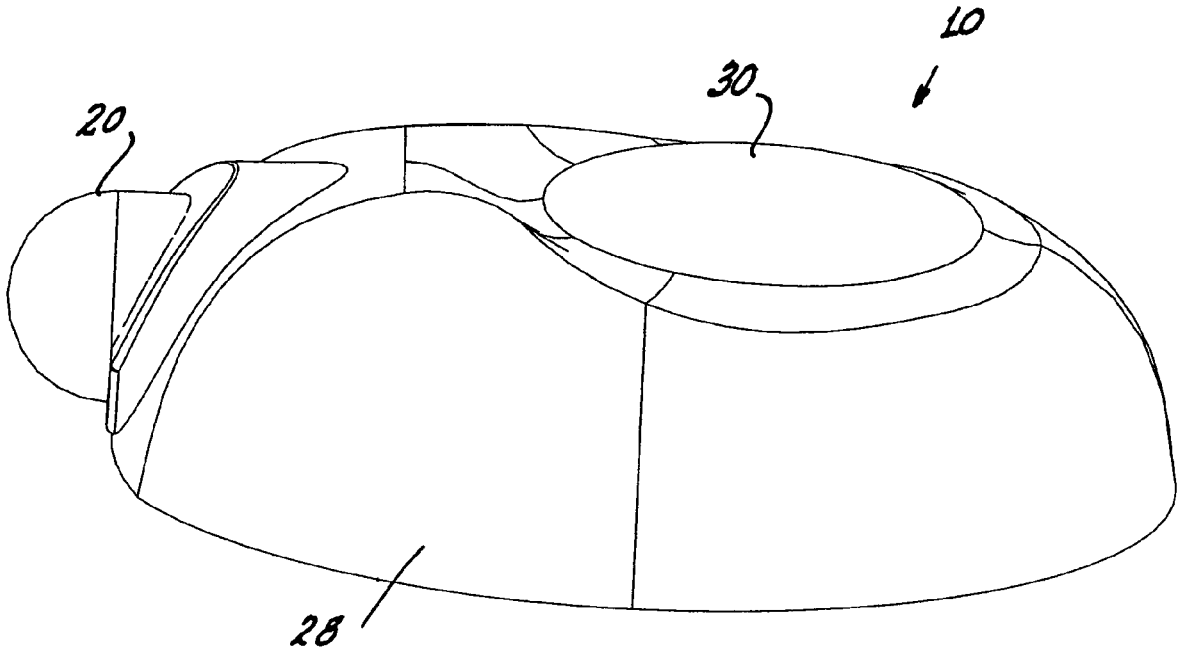
FIG. 1 is an elevational, perspective view of an embodiment of the invention.
Figure 2A:
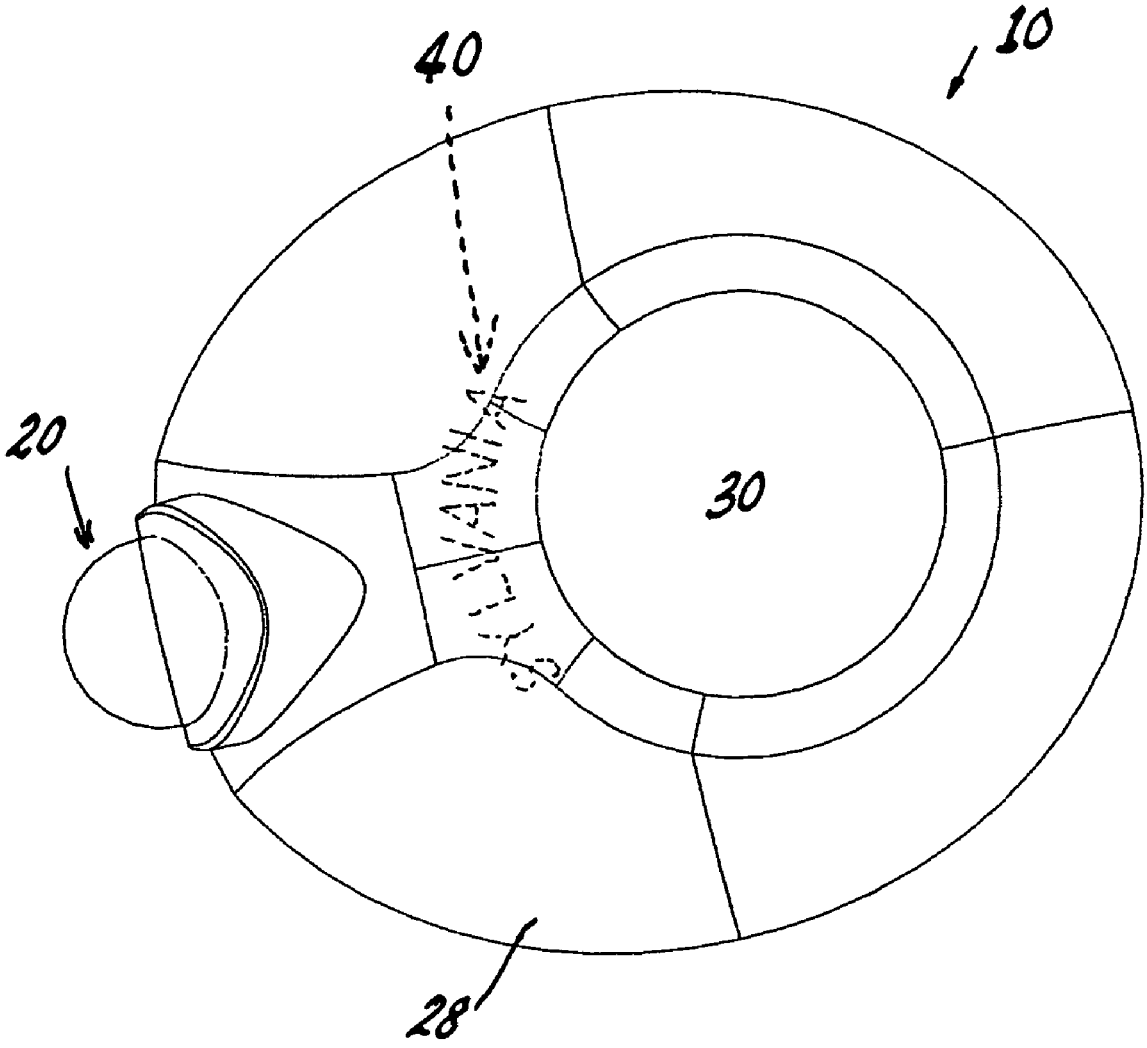
FIG. 2*a* is a plan view of an embodiment of the invention in an un-illuminated condition.
Figure 2B:
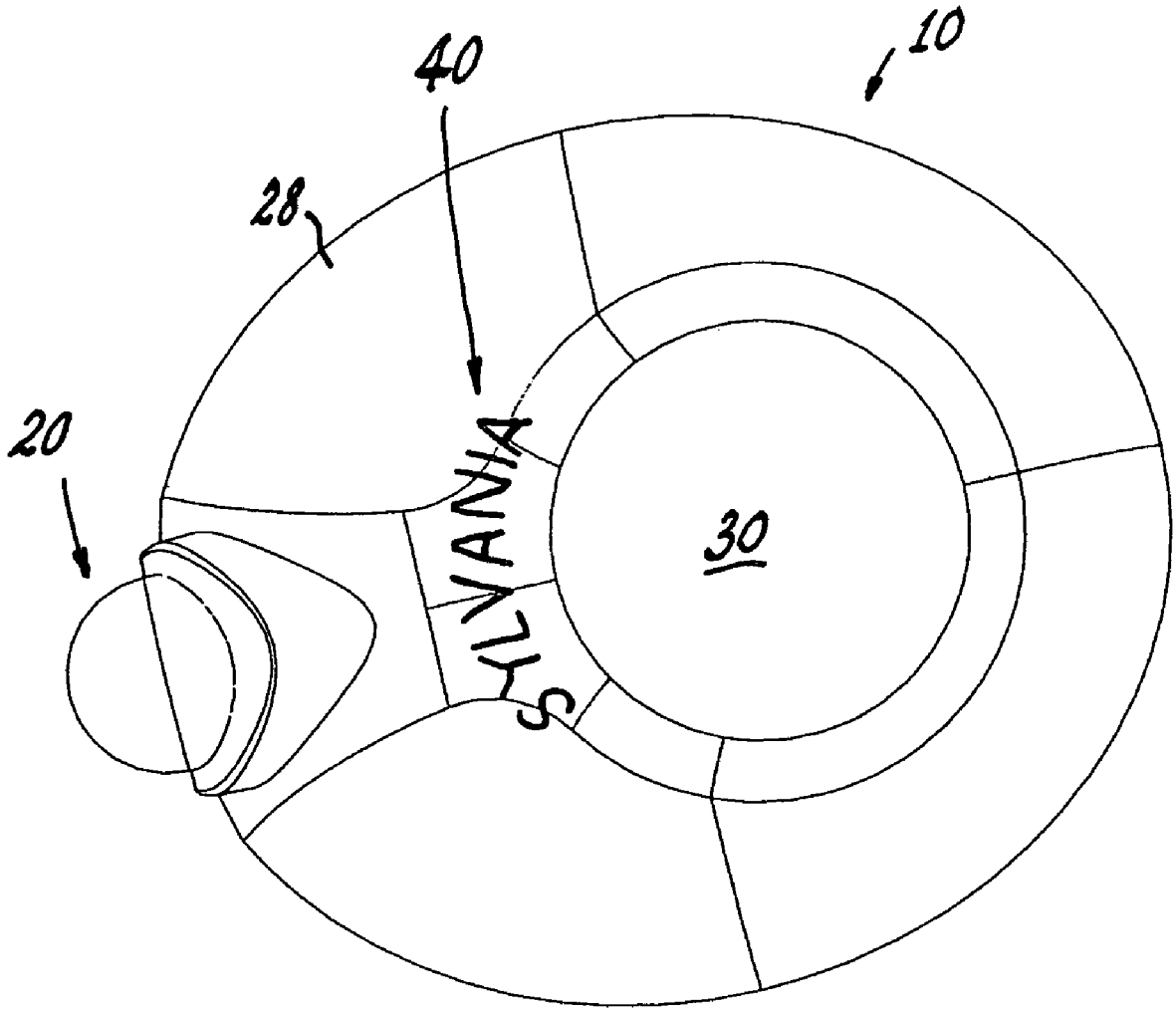
FIG. 2*b* is a similar view in an illuminated condition.

In an embodiment of the invention the flexible cover 28 is translucent and contains substantially invisible indicia 40 thereon, which indicia 40 becomes visible when the light source 20 is energized. This feature is shown more clearly in FIGS. 2*a* and 2*b*. The indicia 40 becomes illuminated because the light source 20 extends both inside and outside of the flexible cover 28 and, preferably, the inside surface 12*a* of the base 12 adjacent the light source 20 is reflective of the light generated by the light source. The indicia can take many forms but alphanumeric or other symbols or icons molded into the inside surface of the flexible cover 28 are very suitable.

The rigid base 12 is formed with an inner battery compartment 42 and a light source compartment 44; the battery compartment 42 including a depression 46 surrounded by a wall 48 adjacent the light source compartment 44. A lead-in opening 50 is formed in the wall 48.

An undercut 52 is formed on an outer surface 54 of the base 12 and engages an inwardly projecting flange 60 formed on the flexible cover 28.

Batteries 56 are fitted within the battery compartment 42 and the light source 20 is fitted within the light source compartment 44. The first lead-in 22 of the light source 20 projects through the lead-in opening 50 and contacts the first pole 16. The second lead-in 24 with its electrical isolation means 26 is positioned over the second pole 18 of the battery 56.

The second lead-in 24 remains out of electrical contact with the second pole 18 until pressure is applied to the cover 28 at portion 30. The applied pressure on the portion 30 of the cover 28 defeats the electrical isolation means 26 and causes a connection between the second lead-in 24 and the second pole 18 of the battery 56 to actuate the light source 20.

Since the portable light shown herein is ideally suited, by virtue of its small size (approximately 1.125"×1"×0.375") for carrying in a pocket or purse, it is preferred that the flexible cover 28 be coated with a friction reducing material. An ideal material for this purpose is parylene, which is available in a number of types.

Figure 3:
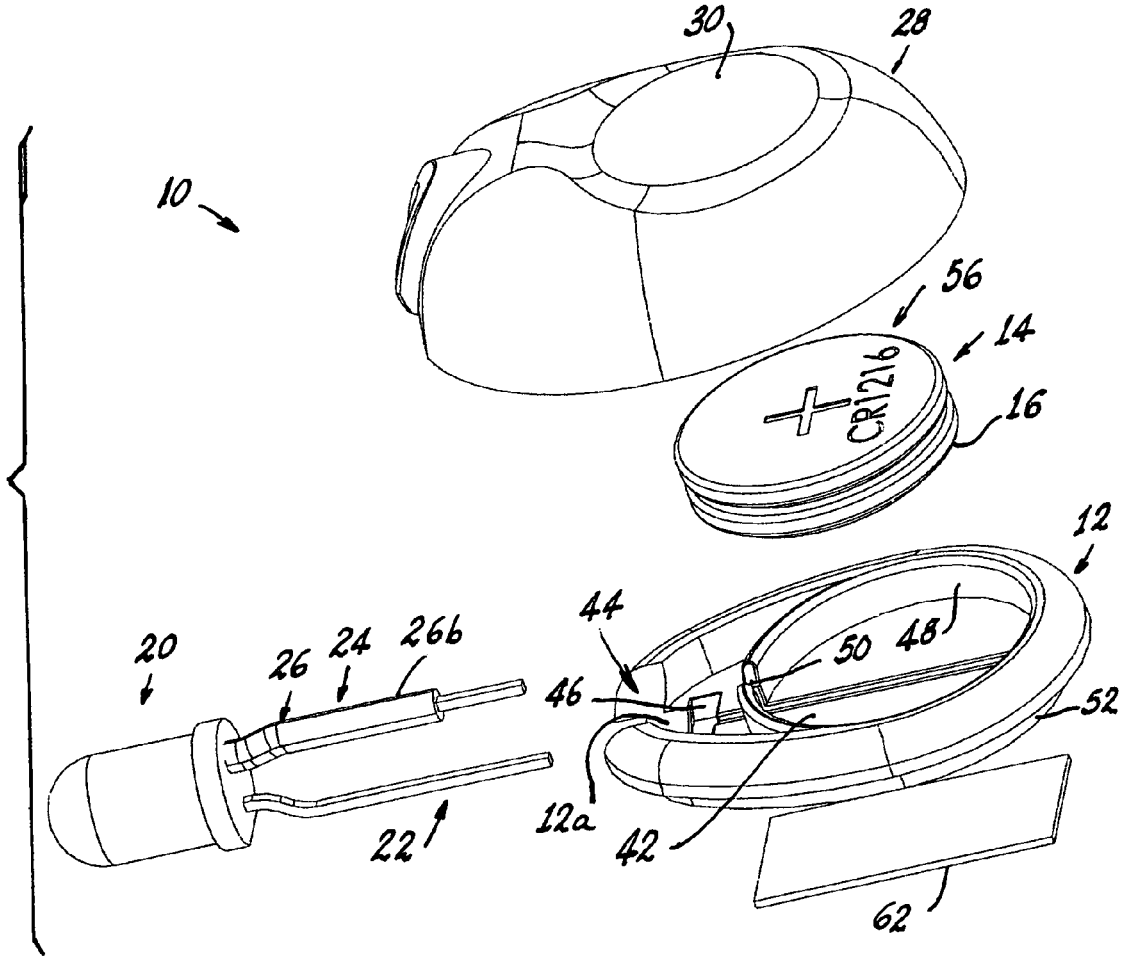
FIG. 3 is an exploded, perspective view of an embodiment of the invention.
Figure 4:
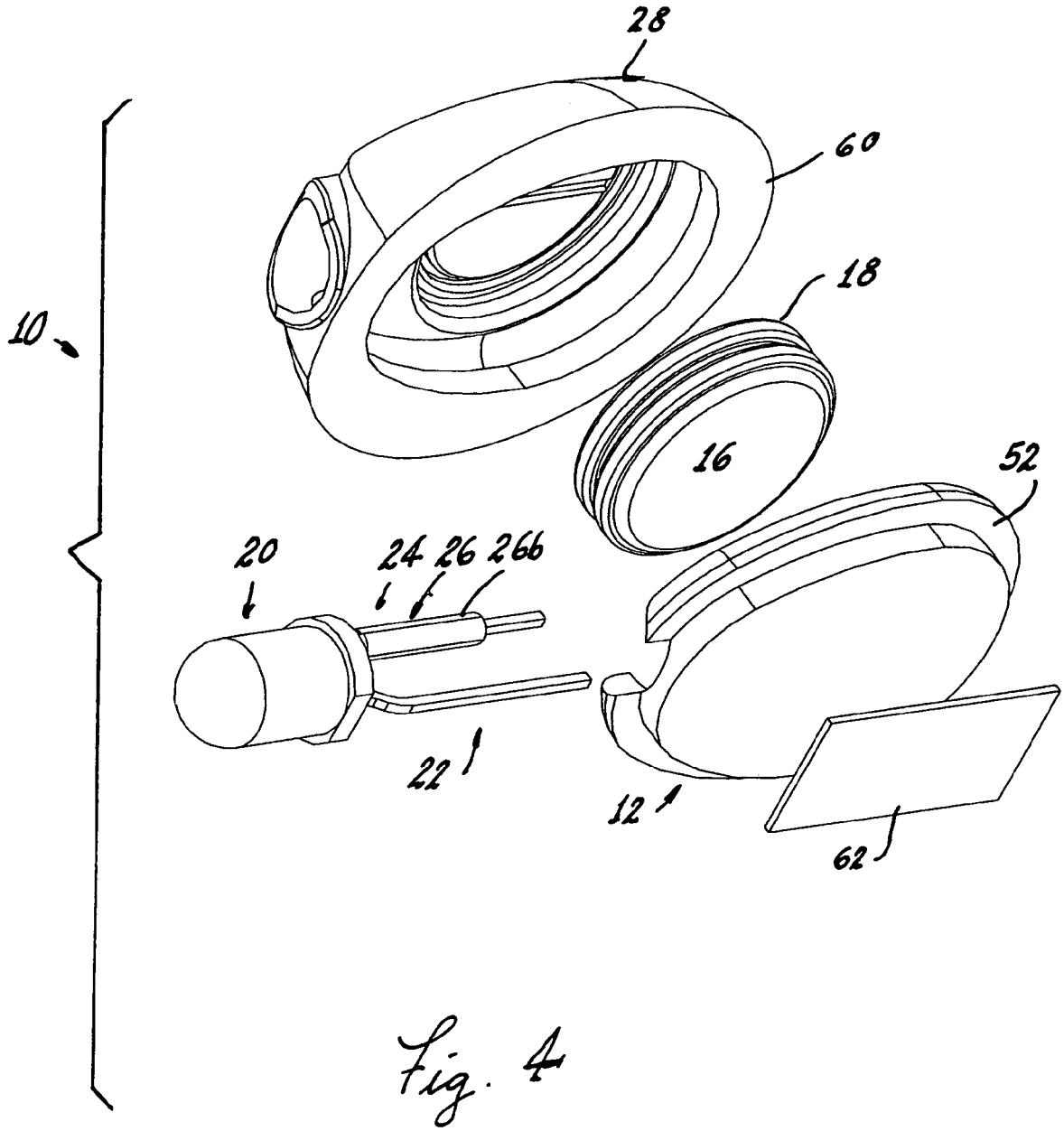
FIG. 4 is an exploded, perspective view from a different angle.

Assembly of the portable light 10 is easily accomplished and is shown in the exploded views of FIGS. 3 and 4. The battery or batteries are inserted into the battery compartment 42, the light source 20 is fitted to the base 12 with the lead-ins appropriately placed over the battery poles and the cover 28 is fitted over base, with the flange 60 engaging the undercut 52.

To aid in placing the portable light 10 in a fixed position, for example, upon a cell phone or a PDA or upon an interior surface of a purse or pocket book, a double-sided adhesive tape 62 is provided on the base 12.

There is thus provided a portable light source that is small and convenient to use, extremely economical to construct as it employs the minimum number of parts necessary to create its illumination; a light source, a power source, a housing to contain them, and a means to actuate the light, with the latter means, of course, being supplied by the person using the light.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. A portable light comprising:

a rigid base;

a power supply having first and second poles within said base;

a light source positioned in said base, said light source having first and second lead-ins, said first lead-in in contact with said first pole of said power supply;

electrical isolation for isolating said second lead-in from said second pole of said power supply, said electrical isolation comprising an electrically insulating sleeve surrounding a portion of said second lead-in; and a flexible cover fitted to said base, said cover including at least one portion contactable with said second lead-in whereby pressure on said at least one portion defeats said electrical isolation means and causes a connection between said second lead-in and said second pole of said power supply to actuate said light source.

2. The portable light of claim 1 wherein said electrically insulating sleeve is adjacent said light source.

3. A light comprising:

a base;

a light source extending beyond said base but at least partially within said base;

a power supply for said light source within said base, said power supply connected to said light source;

a translucent cover fitted over said base, said cover containing substantially invisible indicia thereon, said translucent cover being coated with a friction reducing material; and means associated with said cover for actuating said light source and making said indicia visible.

4. The portable light of claim 1 wherein at least the inside surface of said base adjacent said light source is reflective of the light generated by said light source.

5. A light comprising:

a substantially rigid base having an inner battery compartment and a light source compartment, said battery compartment including a depression surrounded by a wall adjacent said light source compartment;

a lead-in opening formed in said wall;

an undercut on an outer surface of base;

at least one battery within said battery compartment;

a light source within said light source compartment, said light source having first and second lead-ins, said first lead-in projecting through said lead-in opening and contacting a first pole of said at least one battery;

electrical isolation positioned between said second lead-in and said second pole of said battery, said electrical isolation comprises an electrically insulating sleeve surrounding a portion of said second lead-in; and a flexible cover on said base, said cover having an inwardly projecting flange that engages and fits within said undercut on said base and including at least one portion contactable with said second lead-in whereby pressure on said at least one portion of said cover defeats said electrical isolation means and causes a connection between said second lead-in and said second pole of said battery to actuate said light source.

6. The light of claim 5 wherein said electrically insulating sleeve is adjacent said light source.

7. The portable light of claim 1 wherein said flexible cover is coated with a friction reducing material.

8. The portable light of claim 7 wherein said friction reducing material is parylene.

9. The light of claim 3 wherein said friction reducing material is parylene.

10. The light of claim 5 wherein said flexible cover is coated with a friction reducing material.

11. The light of claim 10 wherein said friction reducing material is parylene.

* * * * *